US005405205A

United States Patent [19]

Venthem et al.

[11] Patent Number: 5,405,205

[45] Date of Patent: Apr. 11, 1995

[54] SHEET MEDIUM TRANSPORT SYSTEM, PARTICULARLY FOR PRINTERS AND PLOTTERS

[75] Inventors: John C. Venthem, Georgetown; Marlan L. Schmidt, Pflugerville; James A. Parnell, Austin, all of Tex.

[73] Assignee: Summagraphics Corporation, Austin, Tex.

[21] Appl. No.: 278,556

[22] Filed: Jul. 21, 1994

Related U.S. Application Data

[63] Continuation of Ser. No. 920,115, Jul. 24, 1992, abandoned.

[51] Int. Cl.[6] ..... B41J 13/02

[52] U.S. Cl. ..... 400/634; 101/228; 101/232; 226/95; 226/7; 346/136; 400/636

[58] Field of Search ..... 400/611, 613, 613.3, 400/617, 618, 619, 634, 636, 642, 612, 613.1, 613.2, 605; 226/7, 95, 189, 190, 194, 183; 101/228, 232; 346/1.1, 136, 134

[56] References Cited

U.S. PATENT DOCUMENTS

| | | | |
|---|---|---|---|
| 3,421,612 | 7/1969 | Pitt | 400/636 |
| 3,561,660 | 2/1971 | Nicol et al. | 226/194 |
| 3,649,381 | 3/1972 | Mayhew . | |
| 3,682,407 | 8/1972 | Lichtenstein | 400/619 |
| 3,722,655 | 3/1973 | Singer | 400/619 |
| 3,729,123 | 4/1973 | Lloyd | 226/7 |
| 3,771,702 | 11/1973 | Matsumo et al. . | |
| 3,782,616 | 1/1974 | Surber, Jr. | 226/194 |
| 4,369,453 | 1/1983 | Brandt . | |
| 4,444,522 | 4/1984 | Suzuki et al. | 400/618 |
| 4,646,109 | 2/1987 | Toyama | 346/134 |
| 4,663,638 | 5/1987 | Hirose | 400/613 |
| 4,889,269 | 12/1989 | Long et al. | 226/197 |
| 4,896,980 | 1/1990 | Sanders, Jr. et al. | 400/636 |
| 4,903,045 | 2/1990 | Sakamoto et al. | 226/183 |
| 4,916,466 | 4/1990 | Coste | 346/136 |
| 5,010,816 | 4/1991 | Sarda | 400/618 |
| 5,138,341 | 8/1992 | Kobayashi | 226/181 |
| 5,230,546 | 7/1993 | Germann et al. | 226/194 |
| 5,289,206 | 2/1994 | Ishikawa et al. | 346/134 |
| 5,328,281 | 7/1994 | Narita et al. | 400/605 |

FOREIGN PATENT DOCUMENTS

| | | | |
|---|---|---|---|
| 138117 | 6/1948 | Australia | 226/95 |
| 559388 | 2/1944 | United Kingdom . | |
| 570795 | 7/1945 | United Kingdom | 226/95 |

OTHER PUBLICATIONS

"Vacuum Capstan" IBM Technical Disclosure Bulletin vol. 10, No. 12, May 1968, pp. 1959–1960.

*Primary Examiner*—Eugene H. Eickholt
*Attorney, Agent, or Firm*—Rosen, Dainow & Jacobs

[57] ABSTRACT

The invention disclosed herein provides a method and apparatus for counteracting the effects of a localized drag on a sheet medium as it is being moved by a drive system, for example, in a printer or plotter to prevent misregistration of the sheet medium with the X-axis drive system as the sheet medium is moved past the print or plot head which creates a drag thereon. The sheet medium is stiffened in the region thereof which is contacted by the print or plot head by bending the sheet medium in a direction normal to the direction of movement of the sheet medium. The bend may be provided by a curved guide located between the print or plot head and the X-axis drive system. Friction is reduced between the sheet medium and the curved guide by mounting the curved guide, e.g., one or more rollers, to rotate freely under the action of the sheet medium moving thereover, or by pneumatically supporting the sheet medium above the curved guide as the sheet medium is moved thereover.

14 Claims, 8 Drawing Sheets

SHEET MEDIUM TRANSPORT SYSTEM, PARTICULARLY FOR PRINTERS AND PLOTTERS

RELATED APPLICATION

This application is a continuation, of application Ser. No. 07/920,115, filed Jul. 24, 1992, now abandoned.

The invention disclosed herein may be employed in the thermal printer disclosed in U.S. patent application Ser. No. 07/920,186, filed on even date herewith, titled STRIP MODE PRINTING AND PLOTTING APPARATUS AND METHOD, the disclosure of which is incorporated herein by reference. Application Ser. No. 920,186 and this patent application are commonly owned.

BACKGROUND OF THE INVENTION

The invention disclosed herein relates to a transport system for sheet media, particularly for advancing a sheet medium past a print or plot head in a printer or plotter.

Printers and plotters of the contact type (e.g., pin dot matrix, thermal transfer, direct thermal and pen plotter) employ print or plot heads which contact a sheet medium in order to form an image on the sheet medium, as opposed to non-contact types which typically use electrophotographic imaging techniques. Contact printers and plotters in which the sheet medium is moved past the contact-type print head during printing introduce drag on the drive system which moves the sheet medium. Such drag may present a problem if it is excessive or localized, as discussed below. Typically the sheet medium is moved relative to the print or plot head along the length of the sheet medium, which by convention is parallel to the X-axis of an X-Y coordinate system, and a so-called flying or serial print head is moved parallel to direction of the sheet medium. The drive system which moves the sheet medium is typically referred to as the X-axis drive system.

Such X-axis drag does not typically present a problem when it is distributed across the Y-axis, as for example in line mode type printers where the print head is the same width as the sheet medium. Also, such X-axis drag does not occur where the print head is moved parallel to the Y-axis relative to a stationary sheet medium while printing a line of the image, only after which is the sheet medium moved in the X-direction, as in serial or raster scan-type printers.

Although localized X-axis frictional drag is generated by the down-force of a pen-type plot head against the sheet medium and the supporting platen as the sheet medium is moved past the plot head, it does not usually present a problem because the force is relatively low, e.g., only in the order of 30 grams, which is generally insufficient to cause misregistration of the sheet medium with the X-axis drive system.

In the novel strip mode printing disclosed in application Ser. No. 920,186, printing proceeds in X-axis strips, strip by strip, i.e., a strip which is only part of the Y-axis width of the sheet medium is printed with the print head of the printer held stationary in the strip, then the print head is moved or indexed in the width direction (Y-axis) of the sheet medium to another strip which is printed while the print head is held stationary in that strip. Each strip is substantially narrower than the full width of the sheet medium to be printed upon, and typically several X-axis strips are required to print across the full width of the sheet medium. In thermal transfer strip mode printing as described in Ser. No. 920,186, a receptor sheet medium is continuously moved by the X-axis drive system while the stationary thermal print head of the thermal transfer printer prints the particular strip. The thermal printer utilizes a thermal transfer or donor medium containing a heat activated pigment, wax, resin, ink, etc. layer thereon (hereinafter referred to as "ink") which is transferred in a desired pattern to the receptor medium by the thermal print head. The receptor sheet medium may be paper, plastic, mylar, etc., and the thermal transfer ribbon may be any conventional film having a heat-activated "ink" layer thereon.

During thermal transfer printing, thermal elements in the print head contact the thermal transfer ribbon and press the ribbon against the sheet medium which is supported by a platen. By heat and some pressure the print head activates and transfers the ink carried by the ribbon onto the sheet medium. The ribbon and the sheet medium are maintained in contact and heat is applied by the print head for a predetermined minimum "dwell" time sufficient to effect transfer of the ink to the receptor sheet medium. Typically, the thermal transfer ribbon becomes temporarily adhered to the sheet medium during the dwell time as the ink layer is melted and the ink transferred to the sheet medium. The sheet medium is typically continuously moved past the print head at a rate slow enough to permit the print head to heat and press the ribbon against the sheet medium for at least the minimum required dwell time. The combination of the tension on the ribbon and the down force of the print head against the ribbon and the sheet medium while the ink layer on the ribbon is being melted and the ink transferred to the sheet medium create a drag in the X-axis on the continuously moving sheet medium.

The thermal print head in the thermal printer disclosed in application Ser. No. 920,186 is longer (Y-axis direction) than a typical serial print head and substantially shorter than the width of the sheet medium, e.g., up to about four inches (10.16 cm), so that localized X-axis drag forces occur when the print head is pressed against the sheet medium as the sheet medium is moved in the X-axis relative to the print head. For example, in the thermal printer of application Ser. No. 920,186 the down-force of the thermal print head and transfer ribbon during heating thereof against the sheet medium is typically 1000 grams or more. Such a large down-force produces a resultant frictional drag force, e.g., 525 grams, and when this is applied off center of the sheet medium, sufficient distortion of the sheet medium may occur to cause misregistration of the sheet medium with the X-axis drive system.

Although this drag problem and its solution are described herein in connection with thermal transfer printers, the invention is applicable to other types of printers and plotters where the print head introduces localized X-axis drag against the sheet medium as it moved past the print head, and to other apparatus which transports sheet media in which the sheet medium is subjected to the types of frictional problems described herein.

OBJECTS AND SUMMARY OF THE INVENTION

It is an object of the invention disclosed herein to prevent misregistration of a sheet medium with a drive system moving the sheet medium past a source of drag such as a print or plot head contacting the moving sheet medium.

It is another object of the invention disclosed herein to prevent distortion of a sheet medium moving past a device operating on the sheet medium such as a print or plot head.

The above and other objects are achieved in accordance with the invention by stiffening the sheet medium in the region thereof which is contacted by a drag-inducing device such as print head or plot head. Such stiffening is achieved in accordance with the invention by increasing the section depth normal to axis of movement of the sheet medium (the X-axis in a printer or plotter), as, for example, by bending the sheet medium in a direction normal to the direction of movement of the sheet medium (i.e., in the Y-axis in a printer or plotter).

With specific reference to a printer or plotter, the provision of a bend of small radius in the sheet medium parallel to the Y-axis between the print head or plot head/platen interface and the X-axis drive system adds stiffness to the sheet medium by increasing section depth normal to the X-axis, thus resisting distortion. The bend may be provided by a curved or radiused guide surface located between the print or plot head and the X-axis drive system.

However, as the sheet medium is pulled under the print head where the high frictional drag force is generated, further frictional drag forces are generated between the sheet medium and such a curved guide surface as the sheet medium is pulled around it, in the manner of a rope wrapped around a windlass. In accordance with the invention, these further frictional forces are effectively eliminated or substantially reduced by reducing friction between the curved guide surface and the sheet medium.

According to one embodiment, friction between the curved surface and the sheet medium is reduced by allowing the curved surface to rotate freely under the action of the sheet medium moving thereover. For example, the curved surface may be defined by at least one roller and a means for reducing friction may comprise means for mounting the at least one roller to rotate freely under the action of the sheet medium moving thereover.

By the incorporation of one or more freely rotatable guide rollers at the bend, the "windlass" effect is eliminated, but the increased stiffening of the sheet medium by the bend therein is retained, and is sufficient to overcome the effects of the asymmetrical frictional drag force on sheet medium registration. Preferably, the guide rollers (or curved surface) and drive rollers of the X-axis drive system are positioned such that the sheet medium is presented from the print or plot head/platen interface tangentially to the guide rollers, and also tangentially to the drive rollers from the guide rollers (or curved surface), which eliminates distortion of the sheet medium, due to bending forces, at the point of registration with the X-axis drive system.

In an alternate embodiment, a low friction path between the print or plot head and the X-axis drive system may be provided pneumatically rather than by guide rollers. In that embodiment the sheet medium is made to ride on a cushion of air (or other gas), or on an "air bearing", between the print or plot head/platen interface and the X-axis drive system, and at the same time undergo the bend described above. Accordingly, a means for reducing friction may comprise means for pneumatically supporting the sheet medium above the curved surface as the sheet medium is moved thereover.

In another embodiment, a low friction static flat or configured surface may be provided as the low friction path between the print or plot head/platen interface and the X-axis drive system for use with certain sheet medium.

Depending upon the reduction in friction achieved, it may also be necessary or desirable to provide a more robust X-axis drive system.

However, as presently preferred, stiffening of the sheet medium and reduction in further frictional drag forces is accomplished by providing one or more guide rollers in the sheet medium path downstream of the print or plot head and upstream of the X-axis drive system, and the bend of small radius in the sheet medium parallel to the Y-axis and located between the print or plot head and the X-axis drive system is obtained at the guide rollers by changing the direction of the sheet medium path starting at the guide rollers. Assuming that the sheet medium path from the print or plot head/platen interface is linear, the path change of direction forms an angle with the platen top contact surface. A path change of direction/platen top contact surface angle of 45° is preferred and has been found to provide the desired stiffness, which positions the sheet medium advancing to the guide rollers along a tangent of the guide rollers, and positions the sheet medium advancing to the X-axis drive rollers along a tangent thereof. However, an angle of from about 30° to about 60° will provide a bend in the sheet medium sufficient to stiffen it as described above.

In accordance with a specific embodiment of the invention, a drive and guide system is provided for a sheet medium in a printer or plotter having a print head or a plot head, comprising a first sheet medium guide positioned in the path of movement of the sheet medium downstream of the head and a second sheet medium guide positioned in the path of movement of the sheet medium downstream of the first guide. The first and second guides are configured and positioned to change the direction of movement of the sheet medium downstream of the head at or adjacent the first guide to cause the sheet medium to bend downstream of the head along a direction normal to the direction of movement of the sheet medium for the full extent of the sheet medium in that direction. Also, means are provided for reducing friction between the sheet medium and the first guide.

The first guide comprises a curved surface, e.g., defined by one or more guide rollers, and the second guide comprises means for guiding the sheet medium along a tangent of the curved surface. The second guide may be a planar surface, which may be part of the drive system, or the second guide may be formed by rollers in the drive system. A third guide in the form of a planar surface may be provided between the print or plot head/platen interface and the first guide. The guides may be arranged to provide the change of direction as described above. The means for reducing friction may comprise the means described above.

BRIEF DESCRIPTION OF THE DRAWINGS

The invention disclosed herein is illustrated in the figures of the accompanying drawings which are meant to be exemplary and not limiting, in which like references refer to like or corresponding parts, and in which.

DESCRIPTION OF THE PREFERRED EMBODIMENTS

Figure 1:
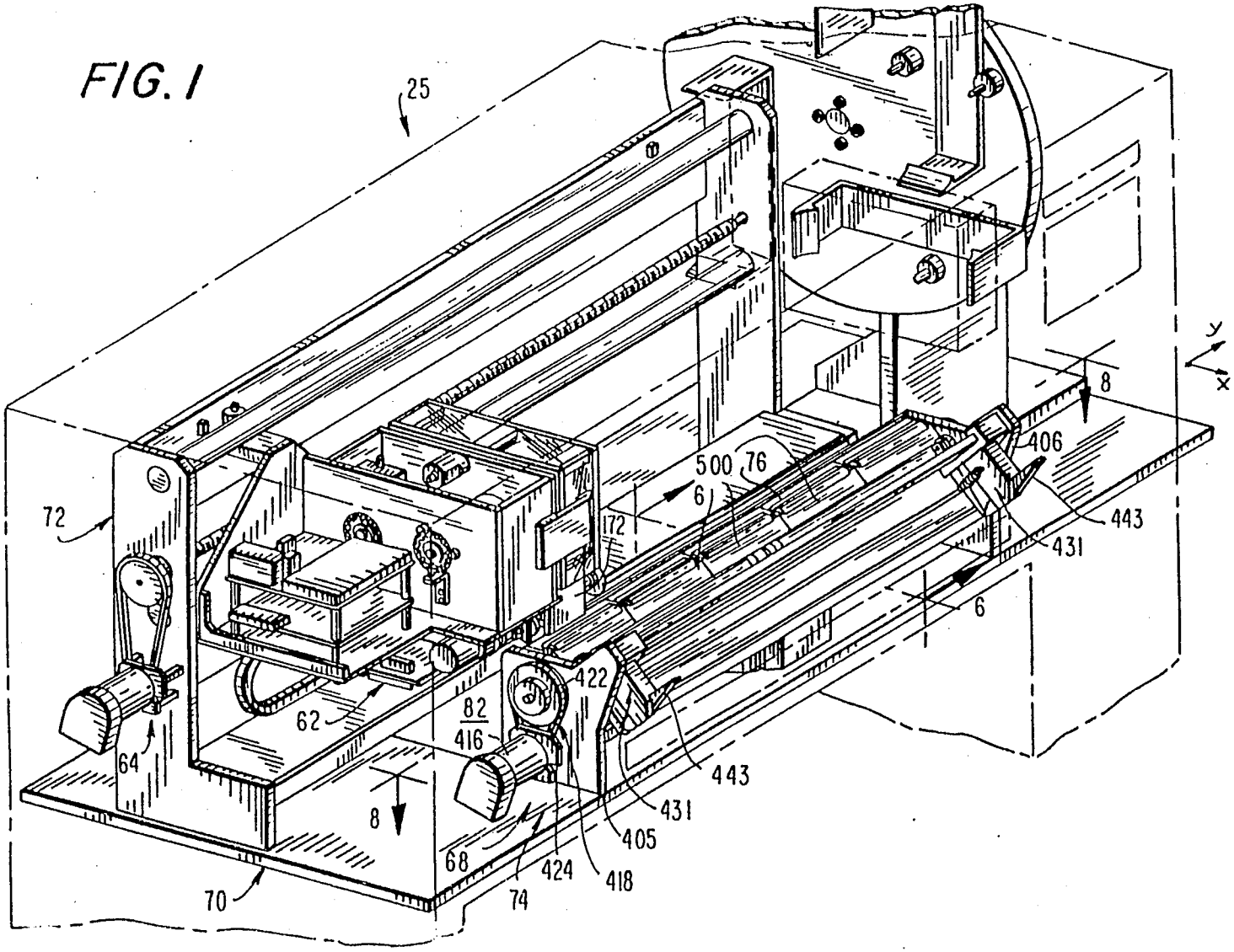
FIG. 1 is a perspective view of a thermal printer employing the invention disclosed herein.
Figure 2:
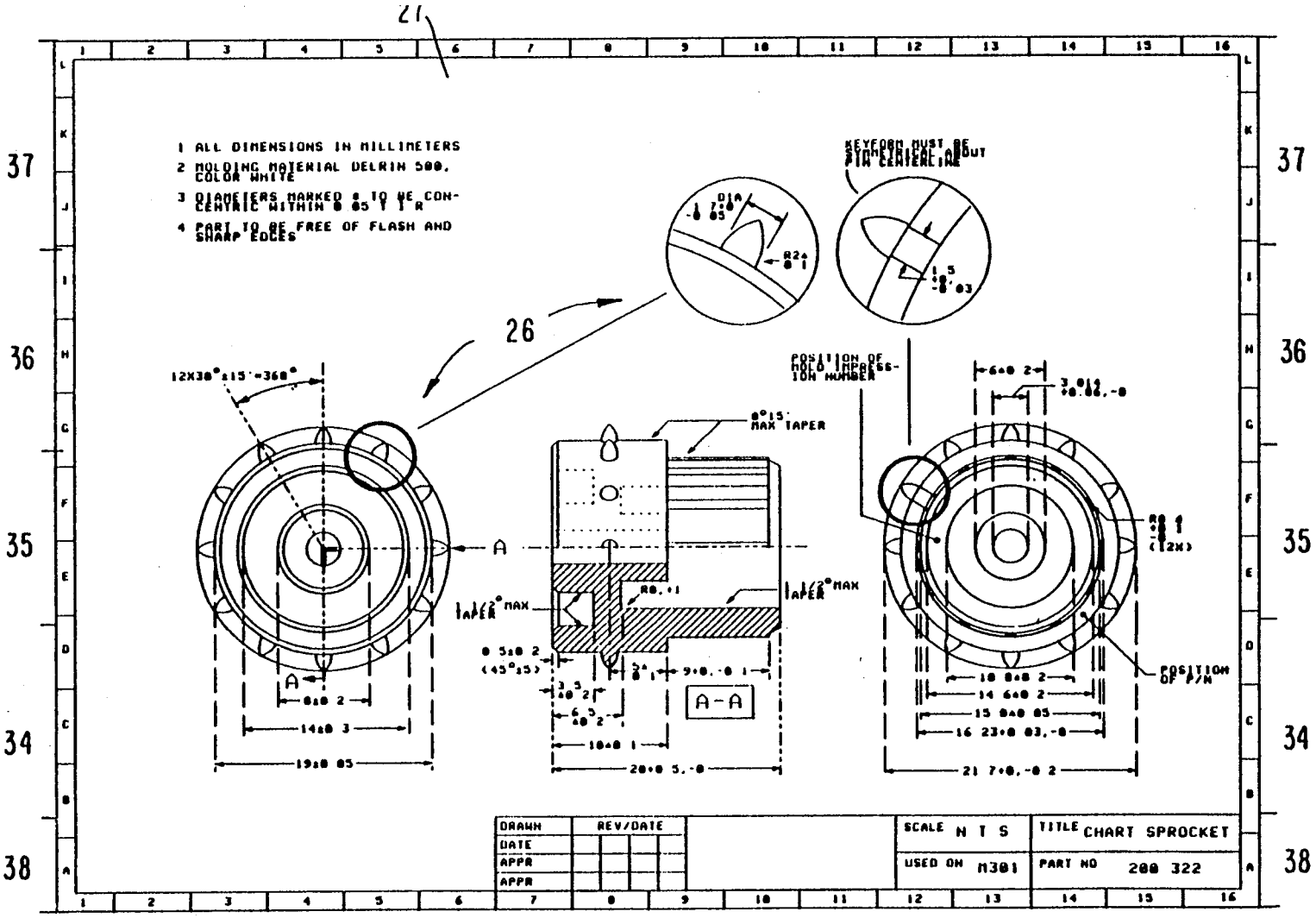
FIG. 2 shows in full an image printed by the thermal printer of FIG. 1.
Figure 4:
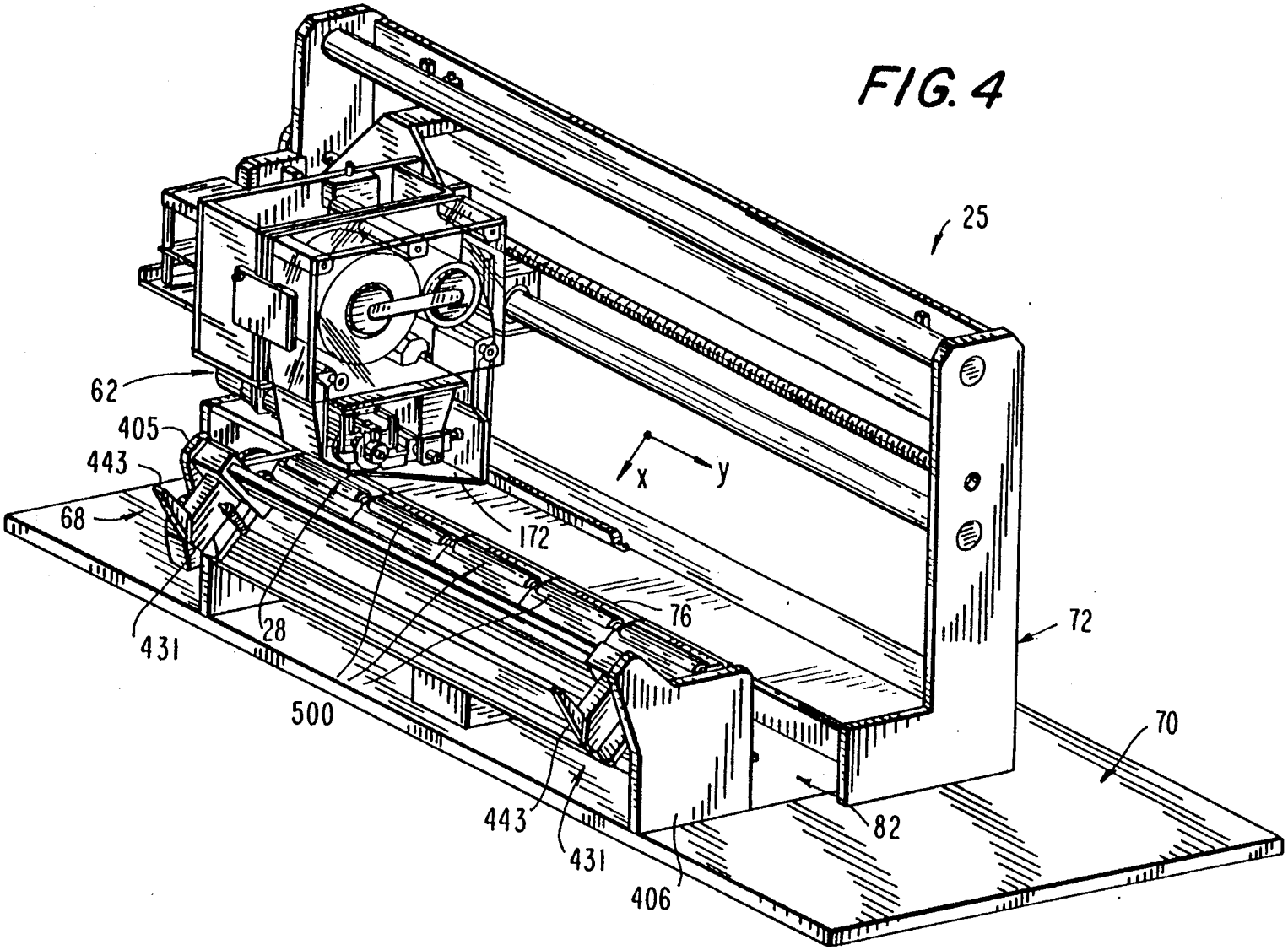
FIG. 4 is a front perspective view from the right side of the thermal printer of FIG. 1 without the cabinet and without the transfer ribbon storage and exchange system.

Thermal printer 25 depicted in FIGS. 1 and 4 prints an image 26 (FIG. 2) on receptor sheet medium 27 (FIG. 5) in the strip printing mode described in detail in application Ser. No. 920,186employing a thermal print head 28 (FIGS. 4–6) and a thermal donor (transfer) ribbon 172. Sheet medium 27 may be paper, plastic, mylar, etc., thermal transfer ribbon 172 may be a conventional film having a heat activated ink layer thereon, and thermal print head 28 may be conventional in so far as the construction and operation of the thermal elements are concerned.

Figure 3:
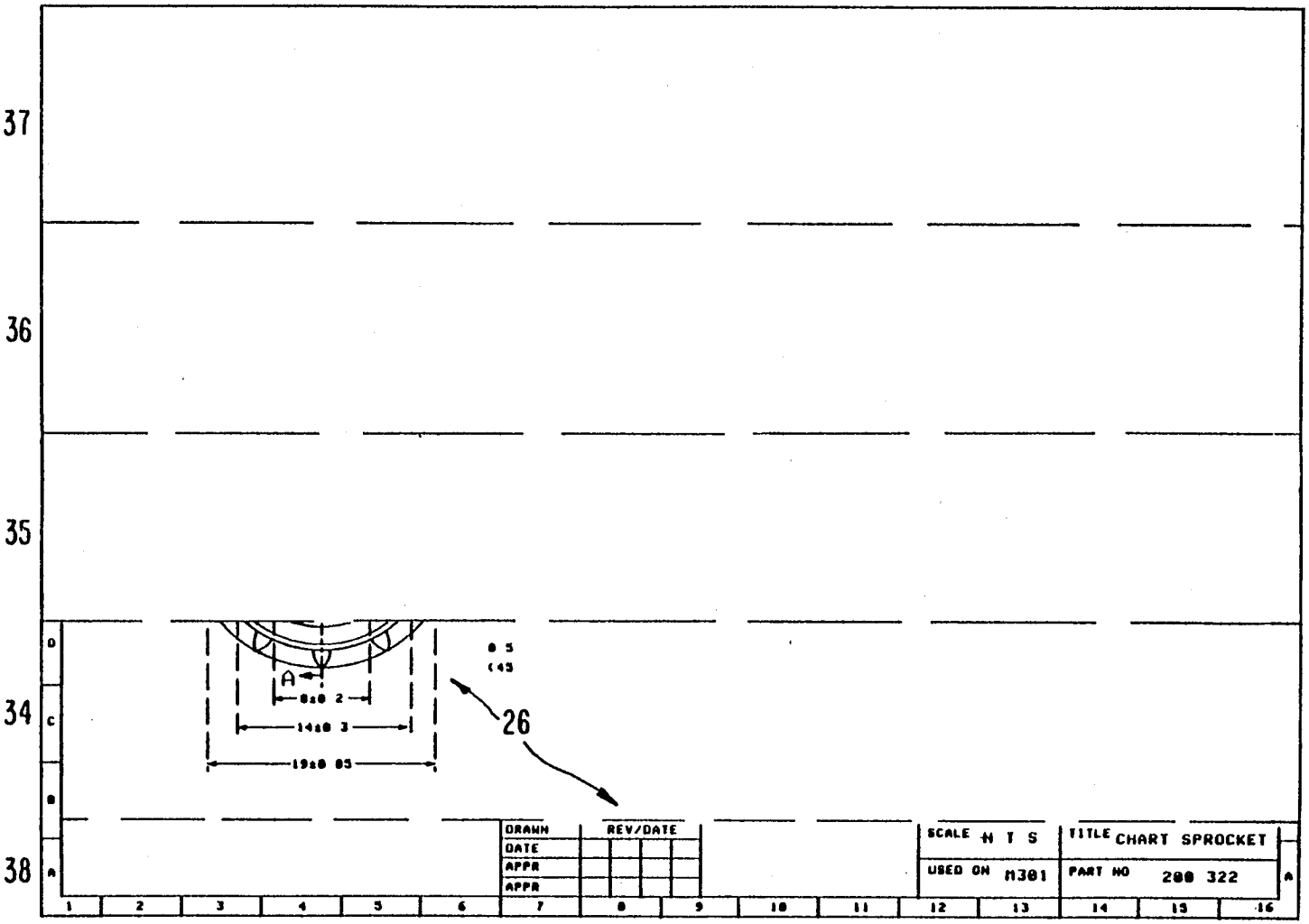
FIG. 3 shows part of the image shown in FIG. 2 with a first strip printed in full and the next strip partially printed.

In strip mode printing as described in application Ser. No. 920,186, print head 28 is moved or indexed parallel to the Y-axis relative to sheet medium 27, and sheet medium 27 is moved back and forth parallel to the X-axis relative to print head 28. Referring to the image shown in FIGS. 2 and 3, print head 28 (not shown in FIGS. 2 and 3) is moved parallel to the Y-axis to position the print head to print in a strip 34–38; then while print head 28 is stationary, sheet medium 27 is moved parallel to the X-axis as print head 28 prints in lines (not shown) each having a width equal to the width of a thermal element array in the print head. Strips 34–37 each have a width equal to the length of the thermal element array of print head 28. Depending upon the particular width of sheet medium 27 and the particular length of the thermal element array, thermal printer 25 may print in one or more partial width strips 38 (FIG. 3) at either or both edges of sheet medium 27 in order to print on the full width of the sheet medium. In the sequence of printing image 26 illustrated by FIGS. 2 and 3, only one partial width strip 38 is required, which is shown fully printed in FIG. 3, and four full width strips are required, only one strip 34 of which is shown partially printed in FIG. 3.

Figure 5:
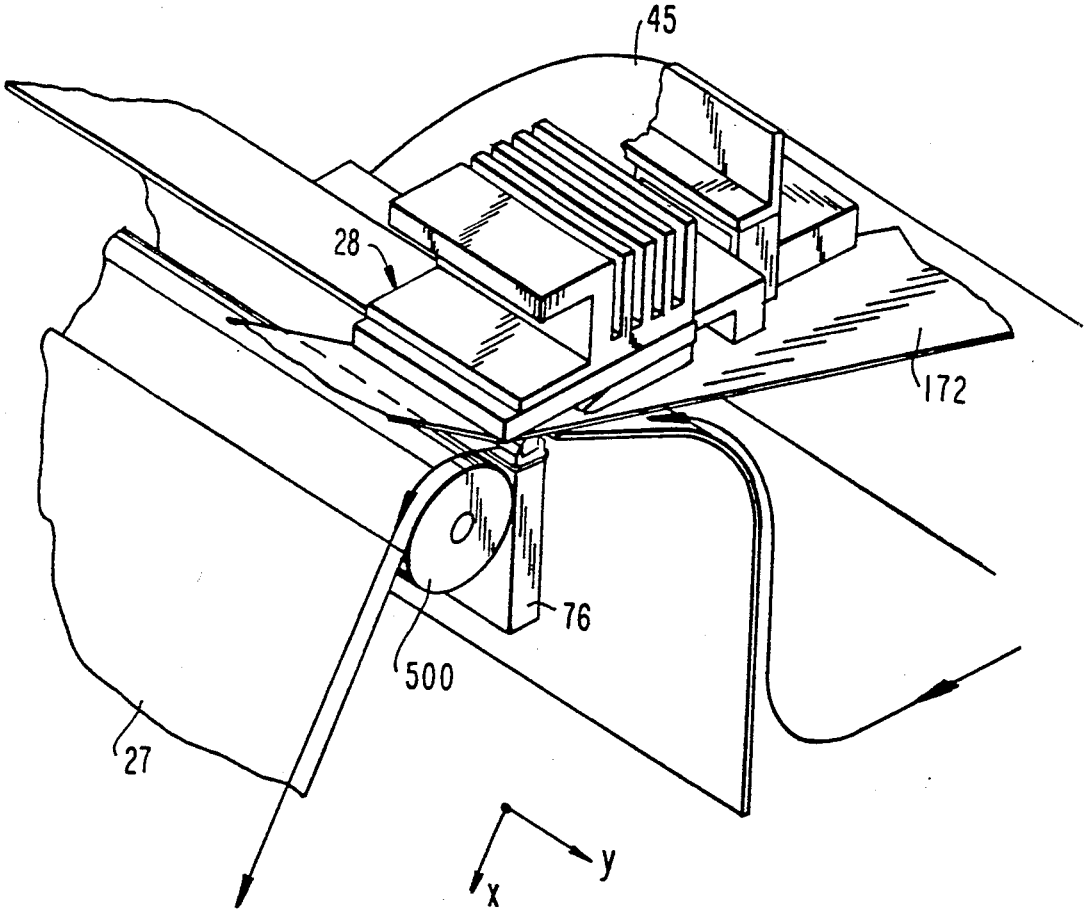
FIG. 5 is an enlarged perspective view from the right side of the thermal printer of FIG. 1 showing the thermal print head, a portion of the print head support, a portion of the platen, a portion of the sheet medium roll with a sheet portion therefrom passing between the print head and the platen, a portion of the thermal transfer ribbon passing between the sheet medium and the print head, and a portion of the X-axis guide roller.

Referring to FIG. 5, during printing, thermal elements in the print head contact thermal transfer ribbon 172 and press the ribbon against sheet medium 27 which is supported by a platen 76. By heat and some pressure for a predetermined minimum "dwell" time, print head 28 activates and transfers ink carried by ribbon 172 onto sheet medium 27 while sheet medium 27 is continuously moved past print head 28. Because print head 28 is substantially less in length (Y-axis) than the width of sheet medium 27, the down force of print head 28 against ribbon 172 and sheet medium 27 while the ink layer is being melted and the ink transferred to the sheet medium 27 create the localized drag described above.

Referring to FIGS. 1 and 4, thermal printer 25 comprises a base 70 to which are mounted in fixed relation to each other a Y-axis frame 72 and an X-axis frame 74. Y-axis frame 72 supports print carriage 62 and a Y-axis drive system 64, and X-axis frame 74 supports platen 76 and an X-axis drive system 68. Sheet medium 27 is fed from a roll (not shown) mounted to base 70 through a slot 82 (FIGS. 1 and 4) therein past print head 28 and platen 76 to X-axis drive system 68.

Figure 8:
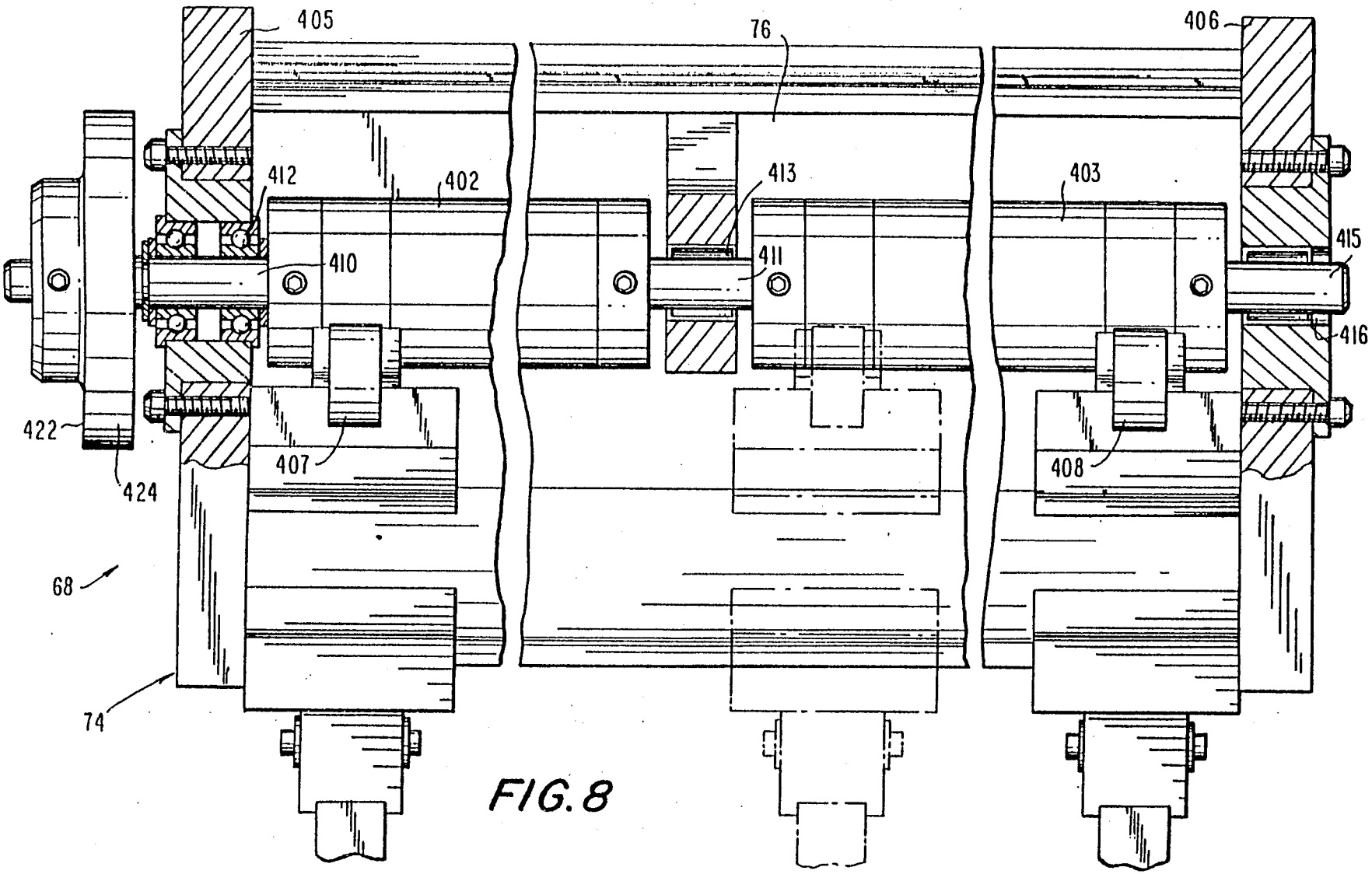
FIG. 8 is a section view of the thermal printer depicted in FIG. 4 taken along line 8—8 in FIG. 1.

X-axis drive system 68 as shown in FIGS. 1, 4 and 8 is of the pinch roller type in which sheet medium is pinched between rigid drive rollers 402, 403 (FIG. 8) and resilient idler rollers 407, 408 (pinch rollers). Drive rollers 402, 403 are driven while pinch rollers 407, 408 are freely rotatable. A drive shaft 410 is fixed to the left end of left drive roller 402 and a short shaft 411 is fixed to the right end of left drive roller 402. Shafts 410 and 411 are supported in respective bearings 412 and 413. Drive shaft 410 is also fixed to pulley 422 so that rotation of pulley 422 rotates left drive roller 402. Short shaft 411 is also fixed to right drive roller 403 at the left end thereof. Another short shaft 415 rotatably supported on a bearing 416 is fixed to the right end of right drive roller 403. Rotation of pulley 422 by X-axis drive motor 416 rotates both drive rollers 402 and 403 via a pulley (not shown) attached to the shaft of motor 416 and a timing belt 424. The position of one pinch roller 407 is adjustable to accommodate sheet medium of different widths.

Figure 6:
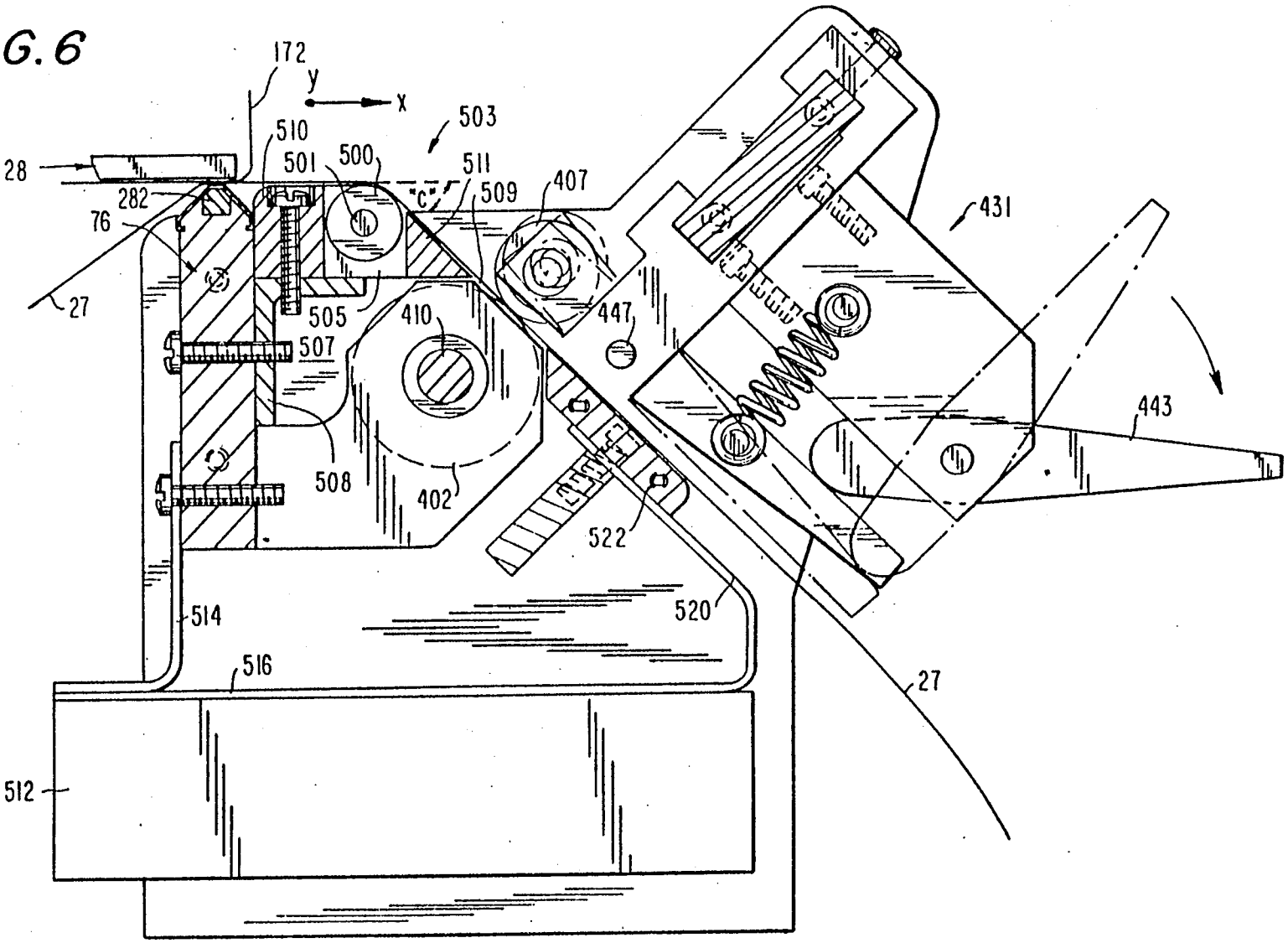
FIG. 6 is a section view of the thermal printer depicted in FIG. 4 taken along line 6—6 in FIG. 1.

Referring to FIG. 6, each pinch roller assembly 431 includes a lever member 443 which when pivoted allows for selectively moving a respective pinch roller 407, 408 away from a respective drive roller 402, 403 in order to freely move sheet medium in the X-direction, as when servicing or removing sheet medium. As in most plotter applications, it is important to accurately position the sheet medium in the X-axis and with precise repeatability. Techniques for accomplishing such accurate positioning are known in the art and are referenced in application Ser. No. 920,186.

Further details of printer 25 are described in application Ser. No. 920,186.

The effects of the drag described above which the invention addresses may be minimized in accordance with the invention by stiffening sheet medium 27 and reducing frictional drag on sheet medium 27 between print head 28 and drive rollers 402, 403. As presently preferred, such stiffening of sheet medium 27 and reduction in drag is accomplished by providing guide rollers 500 (FIGS. 1, 4 and 6) in the sheet medium path downstream of print head 28 and upstream of drive rollers 420, 403 and by providing a bend of small radius in the sheet medium parallel with the Y-axis located between print head 28 and drive rollers 402, 403. Referring to FIG. 6, such bending is obtained at guide rollers 500 by changing the sheet medium path starting at guide rollers 500 by an angle "c" relative the platen top contact surface 282. A bend radius of about ¼ inch has been found to be suitable. However, the particular bend radius and the particular value of angle "c" are not critical. An angle "c" of 45° is preferred and has been found to provide the desired stiffness. A 45° angle "c" positions the sheet medium 27 along a tangent of rollers 500 and along a tangent to the interface of drive roller 402 and pinch roller 407, as shown in FIG. 6. However, an angle "c" of from about 30° to about 60° will provide a bend in sheet medium 27 sufficient to stiffen it as described above.

By the incorporation of one or more freely rotatable guide rollers 500 at the bend, the "windlass" effect of a non-rotatable shaft is eliminated, but the increased stiffening of the sheet medium by the bend therein is retained, and is sufficient to overcome the effects of the asymmetrical frictional drag force on sheet medium registration. Referring to FIG. 6, by positioning drive rollers 402, 403 (not shown in FIG. 6) and pinch rollers 407, 408 (not shown in FIG. 6) of the X-axis drive system 68 such that sheet medium 27 is presented tangentially to guide rollers 500 and also to the print head/-platen interface, distortion of the sheet medium, due to bending forces at the point of registration with the X-axis drive system, is eliminated.

Figure 7:
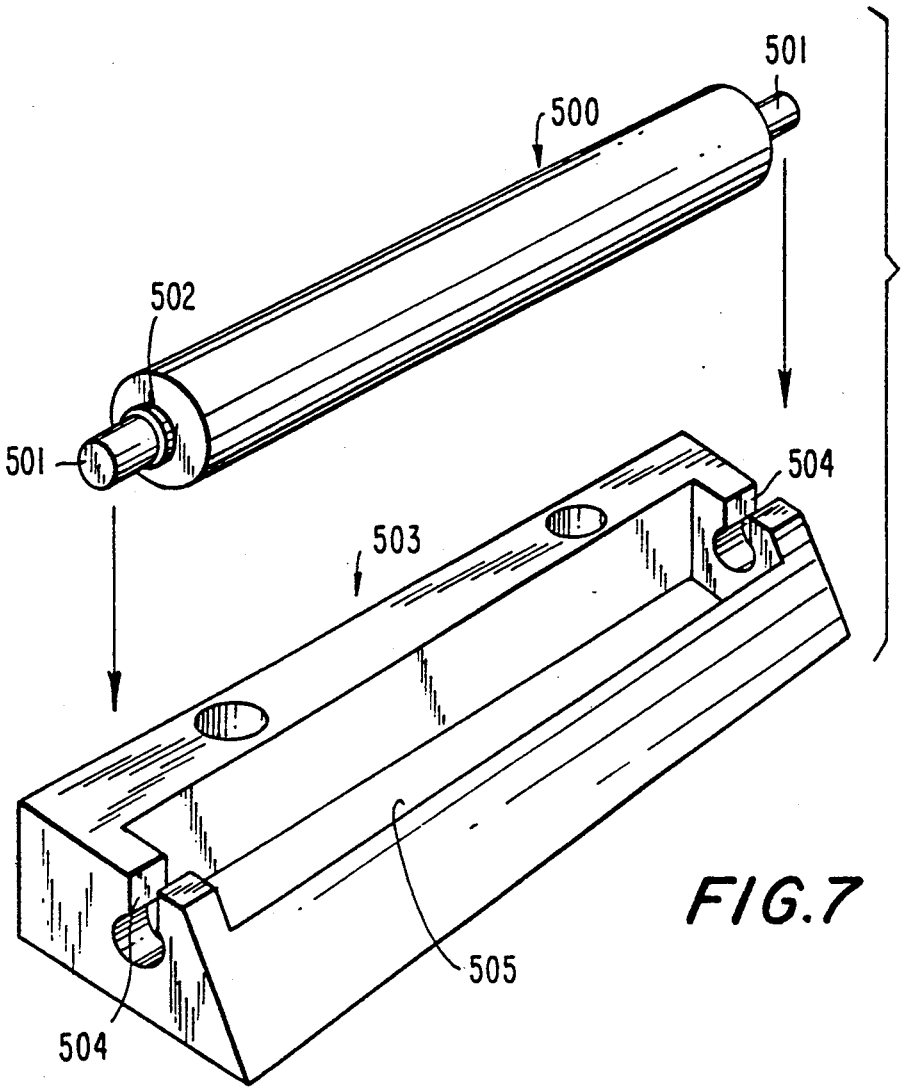
FIG. 7 is an exploded perspective view of one of the X-axis guide rollers and its housing of the thermal printer of FIG. 1.

Referring to FIGS. 6 and 7 five guide rollers 500 each about 5 inches in length are provided to span the full Y-axis width. Each guide roller 500 has stub shafts 501 and locating shoulders 502 at both ends. Guide rollers 500 are rotatably mounted in housings 503. Bearings (slots in plastic housing 503 acts as bearings) rotatably support respective stub shafts 501 in respective slots 504 of respective housings 503. Each guide housing 503 has a slot 505 therein through which suction from a vacuum chamber 507 is applied to sheet medium 27. Guide surfaces 510 and 511 are formed upstream and downstream, respectively of guide rollers 500. Guide 510 defines a first guide surface, guide rollers 500 define a second guide surface, and guide 511 defines a third guide surface. A vacuum chamber 507 is formed below guide roller housings 503 to draw sheet medium 27 against guide rollers 500 when a vacuum is created in vacuum chamber 507 by an exhaust fan 512. Drive rollers 402, 403 extend in a slot 509 in the downstream end of vacuum chamber 507 and sheet medium 27 is also drawn against drive rollers 402, 403 in slot 509 when a vacuum is created in vacuum chamber 507. Vacuum chamber 507 is closed except for slots 505 and 509 and an exhaust port (not shown) communicated with an exhaust fan 512 mounted to cover 516.

The sides of vacuum chamber 507 (FIG. 6) are formed by X-axis frame arms 405, 406. The upstream end of vacuum chamber 507 is formed by platen 76 and a cover 514 connected to platen 76. The bottom of vacuum chamber 507 is formed by another cover 516 connected to cover 514 spaced above base 70. The downstream end of vacuum chamber 507 is formed by a continuation 520 of bottom cover 516 bent upstream towards drive rollers 402, 403, a front sheet medium guide 522 connected to cover continuation 520, and drive rollers 402, 403. Third guide 511 defines the top of vacuum chamber 507 which is formed by guide roller housings 503.

Figure 9:
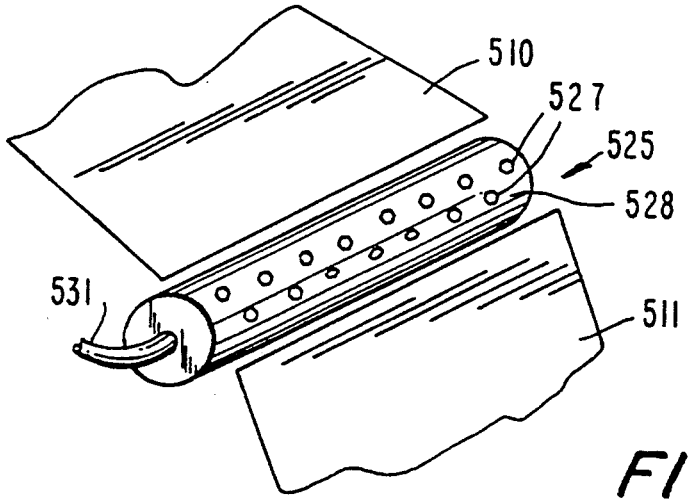
FIG. 9 is schematic drawing showing an alternate embodiment of the invention in the form of an "air bearing".

In an alternative embodiment shown in FIG. 9, a low friction path between print head 28 (not shown in FIG. 9) and drive rollers 402, 403 (not shown in FIG. 9) may be provided pneumatically rather than by guide rollers 500. In that embodiment sheet medium 27 is made to ride on a cushion of air (or other gas), or on an "air bearing", between the platen and the X-axis drive rollers. Referring to FIG. 9, a cylindrical, stationary plenum 525 having holes 527 in the top curved surface thereof 528 is positioned between the print head/platen interface and the X-axis drive system at generally the same location as described above for guide rollers 500. First and third guides 510 and 511 immediately upstream and downstream, respectively, of plenum 525 are positioned to create with curved top surface 528 the bend in sheet medium 27 described above. However, in this embodiment, a vacuum is not set up between guides 510 and 511 where the guide rollers 500 of the previous embodiment were located. The location, geometric configuration (circular, slotted, etc.) and number of holes, and the air pressure provided in plenum 525 are such as to create the cushion of air referred to above which supports sheet medium 27 as it is moved past print head 28 by X-axis drive system 68. Stationary plenum 525 may be provided as a separate cylindrical member as shown in FIG. 9 to which air pressure is supplied via hose 531, or it may form part of vacuum chamber 507, i.e., a static upper surface thereof with holes 527 therein instead of guide rollers 500. Where vacuum chamber 507 is used, a vacuum is not set up therein but rather positive pressure is applied thereto.

In still another embodiment, a low friction static flat or configured surface (not shown) may be provided as the low friction path between print head 28 and X-axis drive rollers 402, 403 for use with certain sheet medium. However, such a static surface may not reduce friction as much as the embodiments described in connection with FIGS. 1–9, and therefore it may also be necessary to provide a more robust X-axis drive system.

The construction of platen 76 also reduces drag on sheet medium 27 as it is moved over the platen with print head 28 pressed against the sheet medium, as described in application Ser. No. 920,186.

While the invention has been disclosed and described with reference to certain embodiments, and with respect to a thermal printer, it will be apparent that variations and modifications may be made thereto and that the invention may be used in other applications. It is therefore intended in the following claims to cover each such variation and modification, and each such use as falls within the spirit and scope of the invention.

What is claimed is:

1. In apparatus for producing images on sheet media including an image forming device which is narrower than the width of a sheet medium being printed upon and which contacts the sheet medium during image production and creates a localized drag thereon, a drive and guide system for the sheet media which counteracts the effects of the localized drag, comprising:

at least one roller in a path of movement of a sheet medium being moved in said apparatus by said drive and guide system, said at least one roller being downstream of said image forming device;

means for urging the sheet medium into contact with said at least one roller as the sheet medium is moved therepast in contact therewith;

means for mounting said at least one roller to rotate freely with low friction under action of the sheet medium being moved therepast in contact therewith so that movement of the sheet medium rotates said at least one roller;

means for engaging the sheet medium downstream of said at least one roller and moving the sheet medium past said at least one roller while changing the direction of movement of the sheet medium downstream of said image forming device at said at least one roller to cause the sheet medium to bend downstream of said image forming device along a direction normal to the direction of movement of the sheet medium for the full extent of the sheet medium in that direction, the friction between the sheet medium and the guide system being reduced at the bend by the freely rotatable mounting of said at least one roller.

2. The drive and guide system of claim 1 and comprising a guide downstream of said at least one roller defining a planar surface positioned along a tangent of said at least one roller.

3. The apparatus of claim 2 wherein said at least one roller and said guide are positioned to bend the sheet medium to form an angle of from about 30° to about 60° after the sheet medium passes the image forming device.

4. The apparatus of claim 1 wherein said means for urging comprises means creating a pneumatic pressure differential on the sheet medium at said at least one roller acting to urge the sheet medium against said at least one roller.

5. The apparatus of claim 1 wherein said means for urging comprises means creating a suction on the sheet medium at said at least one roller acting to urge the sheet medium against said at least one roller.

6. A method of counteracting the effects of a localized drag on a sheet medium as it is being moved by a drive system past a device which forms an image on the sheet medium, comprising:

stiffening the sheet medium downstream and in the region of the localized drag introduced by the image forming device by bending the sheet medium downstream of the localized drag along a direction normal to the direction of movement of the sheet medium for the full extent of the sheet medium in that direction;

urging the sheet medium against an underlying roller using air pressure such that movement of the sheet medium rotates the roller; and reducing friction resisting movement of the sheet medium past the roller by mounting the roller to rotate freely with low friction.

7. The method of claim 6 wherein the step of bending the sheet medium comprises bending it to form an angle of from about 30° to about 60°.

8. The method of claim 6 wherein said step of urging the sheet medium against an underlying roller comprises creating a pneumatic pressure differential on the sheet medium at the roller acting to urge the sheet medium against the roller.

9. The method of claim 6 wherein said step of urging the sheet medium against an underlying roller comprises creating a suction on the sheet medium at the roller acting to urge the sheet medium against the roller.

10. In apparatus for producing images on sheet media including an image forming device which is narrower than the width of a sheet medium being printed upon, and which contacts the sheet medium during image production and creates a localized drag thereon, a drive and guide system for the sheet media which counteracts the effects of the localized drag, comprising:

at least one roller in a path of movement of a sheet medium being moved in said apparatus by said drive and guide system, said at least one roller being downstream of said image forming device;

a sheet medium guide in the path of movement of the sheet medium downstream of said at least one roller;

means for engaging the sheet medium downstream of said guide and moving the sheet medium past said at least one roller and said guide;

means for urging the sheet medium into contact with said at least one roller as the sheet medium is moved therepast in contact therewith:

means for mounting said at least one roller to rotate freely with low friction under action of the sheet medium being moved therepast in contact therewith so that movement of the sheet medium by the means for engaging rotates said at least one roller while changing the direction of movement of the sheet medium downstream of said image forming device between said at least one roller and said guide as the sheet medium is moved therepast to cause the sheet medium to bend at said at least one roller along a direction normal to the direction of movement of the sheet medium for the full extent of the sheet medium in that direction, the friction between the sheet medium and the guide system being reduced at the bend by rotation of said at least one roller.

11. The drive and guide system of claim 10 wherein said guide comprises a fixed, smooth surface which in use contacts the sheet medium.

12. The drive and guide system of claim 11 wherein said smooth surface is planer.

13. The apparatus of claim 10 wherein said means for urging comprises means creating a pneumatic pressure differential on the sheet medium at said at least one roller acting to urge the sheet medium against said at least one roller.

14. The apparatus of claim 10 wherein said means for urging comprises means creating a suction on the sheet medium at said at least one roller acting to urge the sheet medium against said at least one roller.

* * * * *

UNITED STATES PATENT AND TRADEMARK OFFICE

CERTIFICATE OF CORRECTION

PATENT NO. : 5,405,205

DATED : April 11, 1995

INVENTOR(S) : JOHN C. VENTHEM ET AL.

It is certified that error appears in the above-indentified patent and that said Letters Patent is hereby corrected as shown below:

Column 7, line 21, delete "(not shown in FIG. 6)".

Column 7, line 22, delete "(not shown in FIG. 6)".

Column 7, line 24, after "head/" delete "-".

Column 7, line 63, delete "Third guide 511 defines the" and before "top" insert --The--.

Column 7, line 64, delete "which is formed by" and before "guide" insert --defines third--; and after "guide" insert --511 which is formed by guide--.

Signed and Sealed this

Twenty-third Day of April, 1996

Bruce Lehman

*Attest:*

BRUCE LEHMAN

*Attesting Officer*

*Commissioner of Patents and Trademarks*